US009744102B2

(12) United States Patent
Kubo

(10) Patent No.: US 9,744,102 B2
(45) Date of Patent: Aug. 29, 2017

(54) CONNECTION DEVICE

(71) Applicant: NIPRO CORPORATION, Osaka-shi, Osaka (JP)

(72) Inventor: Tomohiko Kubo, Osaka (JP)

(73) Assignee: NIPRO CORPORATION, Osaka-shi, Osaka (JP)

( * ) Notice: Subject to any disclaimer, the term of this patent is extended or adjusted under 35 U.S.C. 154(b) by 307 days.

(21) Appl. No.: 14/650,120

(22) PCT Filed: Nov. 25, 2013

(86) PCT No.: PCT/JP2013/081628
§ 371 (c)(1),
(2) Date: Jun. 5, 2015

(87) PCT Pub. No.: WO2014/091912
PCT Pub. Date: Jun. 19, 2014

(65) Prior Publication Data

US 2015/0313797 A1 Nov. 5, 2015

(30) Foreign Application Priority Data

Dec. 10, 2012 (JP) ..... 2012-269015

(51) Int. Cl.
*A61J 1/20* (2006.01)

(52) U.S. Cl.
CPC ..... *A61J 1/2096* (2013.01); *A61J 1/2013* (2015.05); *A61J 1/2055* (2015.05)

(58) Field of Classification Search
CPC ..... A61J 1/2013; A61J 1/2096; A61J 1/2055; A61J 1/1418
See application file for complete search history.

(56) References Cited

U.S. PATENT DOCUMENTS

2004/0122374 A1 6/2004 Hasegawa
2012/0123382 A1 5/2012 Kubo

FOREIGN PATENT DOCUMENTS

JP 2004-194953 A 7/2004
JP 2007-260162 A 10/2007
WO WO 2007/068825 A1 6/2007
WO WO 2008/006439 A1 1/2008
WO WO 2011/007760 A1 1/2011

*Primary Examiner* — Leslie Deak
(74) *Attorney, Agent, or Firm* — Birch, Stewart, Kolasch & Birch, LLP

(57) ABSTRACT

In a connection device, when a cannula holding member is in a use state, a position of an end portion of an outer cylindrical portion on a retracted position side does not protrude to the retracted position side, with respect to a position of an end portion of an inner cylindrical portion on the retracted position side. Thereby, a connection device including a structure capable of holding a vial by holding means irrespective of the size of the vial can be provided.

3 Claims, 9 Drawing Sheets

(A)

CONNECTION DEVICE

TECHNICAL FIELD

The present invention relates to a connection device connecting a syringe and a vial.

BACKGROUND ART

A connection device switching from a pre-use state in which a syringe and a vial are spaced from each other and a double-head cannula does not penetrate a lid member of the syringe and a lid member of the vial, to a use state in which the syringe and the vial are brought close to each other and the double-head cannula penetrates the lid member of the syringe and the lid member of the vial to establish communication between an internal space of the syringe and an internal space of the vial is conventionally known.

As such a connection device, a connection device in which a syringe and a vial are connected to both ends of cylindrical holding means and a double-head cannula is provided to be movable inside the holding means is disclosed in International Publication No. 2011/007760 (PTD 1), Japanese Patent Laying-Open No. 2007-260162 (PTD 2), and Japanese Patent Laying-Open No. 2004-194953 (PTD 3).

According to these connection devices, by bringing the syringe close to the vial held by the holding means, the double-head cannula can penetrate a lid member of the syringe and a lid member of the vial to establish communication between an internal space of the syringe and an internal space of the vial.

In addition, the connection device disclosed in International Publication No. 2011/007760 (PTD 1) includes separation preventing means which prevents a user from forgetting to perform an operation of establishing communication between the syringe and the vial, in order to prevent the user from erroneously separating the syringe from the holding means without establishing communication between the syringe and the vial, and using the syringe without mixing a solution inside the syringe with a medicament inside the vial.

CITATION LIST

Patent Document

PTD 1: International Publication No. 2011/007760
PTD 2: Japanese Patent Laying-Open No. 2007-260162
PTD 3: Japanese Patent Laying-Open No. 2004-194953

SUMMARY OF INVENTION

Technical Problem

The connection device described above employs a configuration of connecting the syringe and the vial to both ends of the cylindrical holding means. When the holding means holds the vial, if a bottle portion of the vial has a large outer diameter, a tip end portion of the cylindrical holding means may abut on the bottle portion of the vial and the holding means cannot hold the vial.

Accordingly, the present invention has been made in view of the aforementioned problem, and one object of the present invention is to provide a connection device including a structure capable of holding a vial by holding means irrespective of the size of the vial.

Solution to Problem

A connection device in accordance with the present invention is a connection device including holding means spacing a syringe and a vial from each other or bringing the syringe and the vial close to each other, and a double-head cannula which is located between a syringe lid member attached to the syringe and a vial lid member attached to a ring member provided to the vial, and which can penetrate the syringe lid member and the vial lid member, the connection device switching from a pre-use state in which the holding means spaces the syringe and the vial from each other and the double-head cannula does not penetrate the syringe lid member and the vial lid member, to a use state in which the holding means brings the syringe and the vial close to each other and the double-head cannula penetrates the syringe lid member and the vial lid member to establish communication between internal spaces of the syringe and the vial. The connection device includes the following features.

The holding means includes: a syringe holding member to be attached to the syringe; a cannula holding member which has the double-head cannula, is located at a retracted position retracted with respect to the syringe holding member in the pre-use state, and is advanced to an advanced position abutting on the syringe holding member in the use state; and separation preventing means which engages the syringe to prevent separation of the syringe from the syringe holding member in the state where the cannula holding member is located at the retracted position, and releases an engagement state with the syringe to permit the separation of the syringe from the syringe holding member when the cannula holding member is located at the advanced position.

The syringe holding member has an outer cylindrical portion which is opened on a retracted position side and accommodates the cannula holding member to be movable between the retracted position and the advanced position. The cannula holding member has an inner cylindrical portion which is opened on the retracted position side, is accommodated inside the outer cylindrical portion, and holds the ring member of the vial. When the cannula holding member is in the use state, a position of an end portion of the outer cylindrical portion on the retracted position side does not protrude to the retracted position side, with respect to a position of an end portion of the inner cylindrical portion on the retracted position side.

In another embodiment, an engagement mechanism is provided between the outer cylindrical portion and the inner cylindrical portion. In a state where the inner cylindrical portion does not hold the ring member, movement of the inner cylindrical portion to the advanced position is prevented by the engagement mechanism, and, in a state where the inner cylindrical portion holds the ring member, the movement of the inner cylindrical portion to the advanced position is permitted by releasing the engagement mechanism.

In another embodiment, the engagement mechanism includes: an outer cylinder-side flexible pawl which is provided in a side surface portion of the outer cylindrical portion, and is inclined inward on the retracted position side as the outer cylinder-side flexible pawl extends from an advanced position side to the retracted position side; an inner cylinder-side flexible pawl which is provided in a side surface portion of the inner cylindrical portion, is inclined inward on the advanced position side as the inner cylinder-side flexible pawl extends from the retracted position side to the advanced position side, and is located to be overlapped by the outer cylinder-side flexible pawl in a state where the inner cylindrical portion is accommodated inside the outer cylindrical portion; and an inner cylinder abutting surface which is provided in the side surface portion of the inner cylindrical portion, is located outside the inner cylinder-side flexible pawl in a circumferential direction of the inner cylindrical portion, and can abut on a tip end portion of the outer cylinder-side flexible pawl.

In the state where the inner cylindrical portion does not hold the ring member, the movement of the inner cylindrical portion to the advanced position is prevented by the tip end portion of the outer cylinder-side flexible pawl abutting on the inner cylinder abutting surface, and, in the state where the inner cylindrical portion holds the ring member, the movement of the inner cylindrical portion to the advanced position is permitted by releasing abutting of the tip end portion of the outer cylinder-side flexible pawl on the inner cylinder abutting surface by pushing the inner cylinder-side flexible pawl outward by the ring member and thereby also pushing the outer cylinder-side flexible pawl outward.

Advantageous Effects of Invention

According to the connection device in accordance with the present invention, a connection device including a structure capable of holding a vial by holding means irrespective of the size of the vial can be provided.

DESCRIPTION OF EMBODIMENTS

Hereinafter, a connection device in accordance with the present invention will be described in an embodiment, with reference to the drawings. It is noted that, when the number, amount, or the like is referred to in the embodiment described below, the scope of the present invention is not necessarily limited to such a number, amount, or the like, unless otherwise specified. In addition, it is originally intended to combine features described in the embodiment as appropriate for use.

Figure 1:
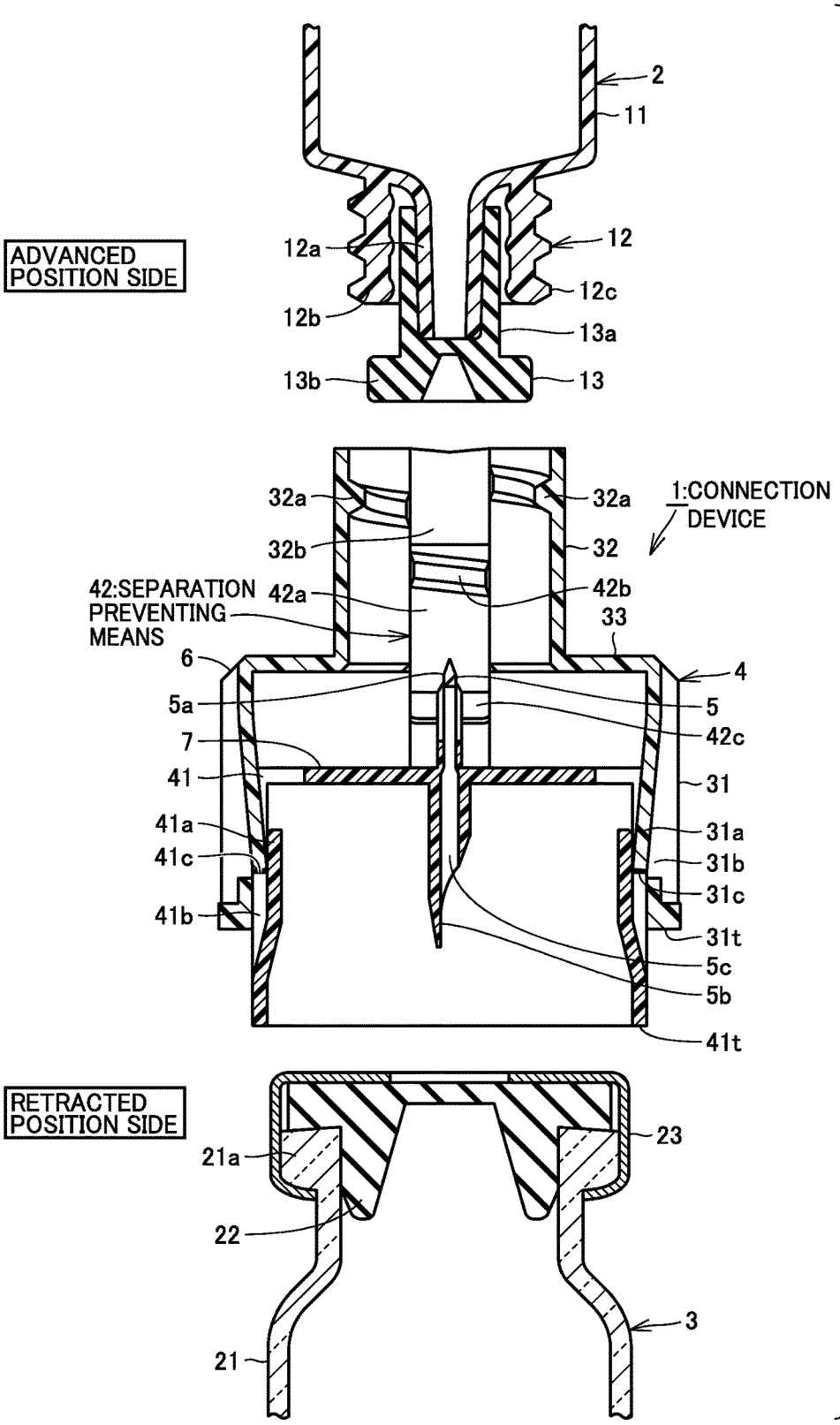
FIG. 1 is a cross sectional view showing structures of a syringe, a vial, and a connection device in the present embodiment.
Figure 2:
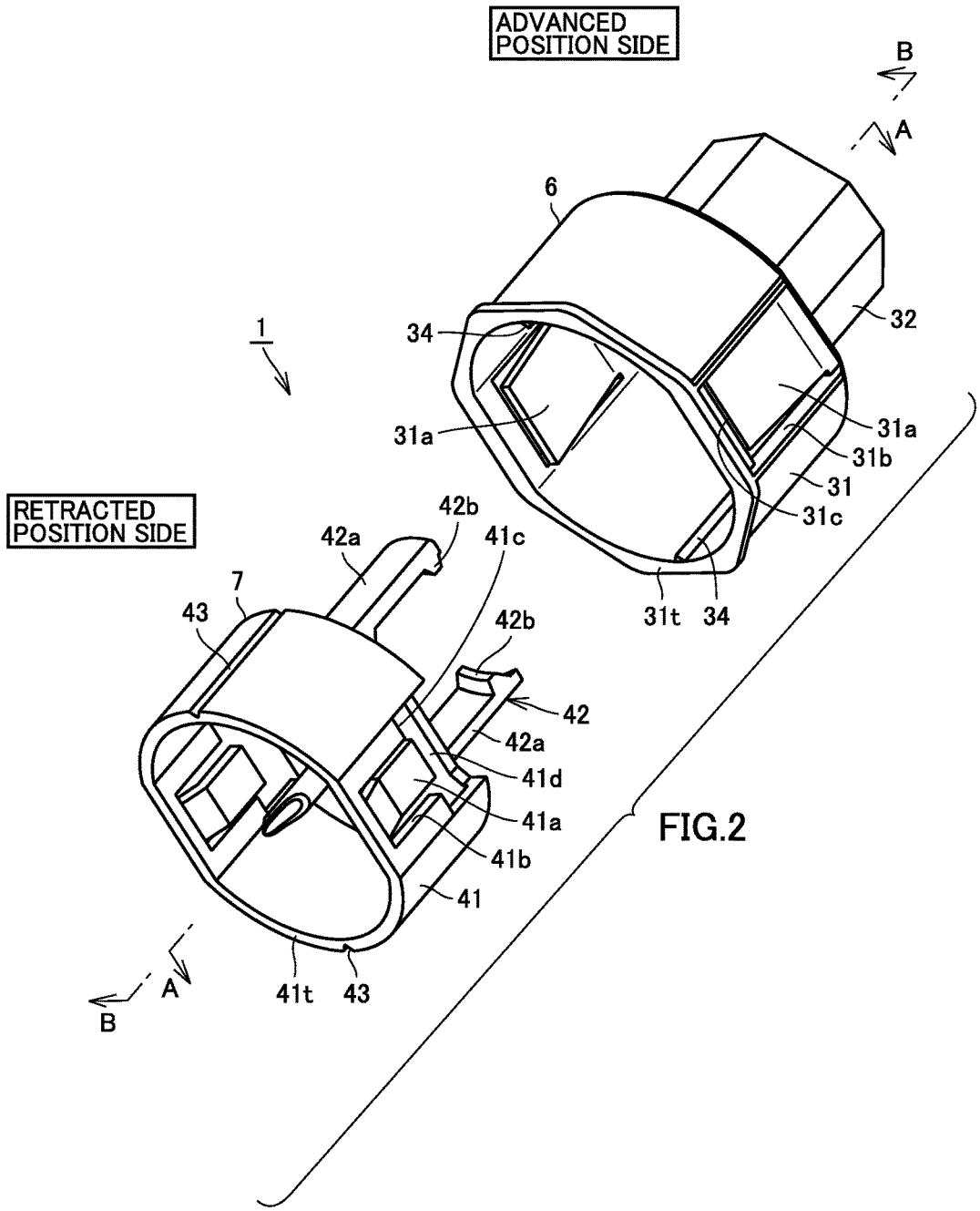
FIG. 2 is a perspective view showing the structure of the connection device in the present embodiment.

Referring to FIGS. 1 and 2, a connection device 1 in the present embodiment will be described. FIG. 1 is a cross sectional view showing structures of a syringe 2, a vial 3, and connection device 1 in the present embodiment, and FIG. 2 is a perspective view showing the structure of connection device 1 in the present embodiment.

(Schematic Configuration of Connection Device 1)

Connection device 1 includes holding means 4 spacing syringe 2 and vial 3 from each other or bringing them close to each other, and a double-head cannula 5 which is located between a syringe lid member 13 attached to syringe 2 and a vial lid member 22 attached to a ring member 23 provided to vial 3, and which can penetrate syringe lid member 13 and vial lid member 22.

Holding means 4 is composed of a syringe holding member 6 to be attached to syringe 2, and a cannula holding member 7 having double-head cannula 5. Syringe holding member 6 and cannula holding member 7 are provided to be capable of being advanced and retracted (i.e., moving forward and backward) in an up-down direction in FIG. 1. Syringe holding member 6 and cannula holding member 7 are mainly made of polypropylene, polyethylene, polyester, polyvinyl chloride, ABS resin, or any other flexible resin.

In the following description, an "axial direction" refers to a direction parallel to a central axis of syringe 2, "forward" refers to an upward direction in FIG. 1, that is, a direction in which vial 3 comes close to syringe 2 (an advanced position), and "backward" refers to a downward direction in FIG. 1, that is, a direction in which vial 3 is spaced from syringe 2 (a retracted position).

(Syringe 2)

Syringe 2 is composed of a barrel 11 storing a solution, and a plunger not shown advanced and retracted inside barrel 11, and a connection portion 12 is provided at a tip end of barrel 11. Connection portion 12 has a hollow tapered portion 12*a* in communication with the inside of barrel 11, and a mouth portion 12*b* provided to surround tapered portion 12*a*. An external thread portion 12*c* is formed on an outer periphery of mouth portion 12*b*.

Grooves 12*d* (see FIG. 3) are formed in external thread portion 12*c* in a forward-backward direction, at opposite positions with the central axis sandwiched therebetween. By grooves 12*d*, external thread portion 12*c* is interrupted and discontinuous.

Rubber syringe lid member 13 is attached to tapered portion 12*a*. Syringe lid member 13 is composed of a small diameter portion 13*a* which covers tapered portion 12*a* and has a diameter smaller than that of mouth portion 12*b*, and a large diameter portion 13*b* with a large diameter provided at a tip end of small diameter portion 13*a*. Large diameter portion 13*b* has a thin center.

(Vial 3)

Vial 3 has a glass bottle portion 21 storing a medicament, rubber vial lid member 22 attached to an opening of bottle portion 21, and metal ring member 23 fixing vial lid member 22 to the opening of bottle portion 21.

A flange portion 21*a* having a diameter substantially identical to that of vial lid member 22 is formed at the opening of bottle portion 21. Vial lid member 22 is formed to have a thin center. Ring member 23 surrounds flange portion 21*a* and vial lid member 22 to fasten them integrally, and a thin portion of vial lid member 22 is exposed to the outside.

(Syringe Holding Member 6)

Syringe holding member 6 has an outer cylindrical portion 31 in the shape of a cylinder which is opened on a retracted position side and provided to cover cannula holding member 7, and an attachment portion 32 in the shape of a cylinder which has a diameter smaller than that of outer cylindrical portion 31 and is to be connected with connection portion 12 of syringe 2. A step difference portion 33 is formed between outer cylindrical portion 31 and attachment portion 32.

In a side surface portion of outer cylindrical portion 31, two outer cylinder-side flexible pawls 31*a*, each of which is inclined inward on the retracted position side as it extends from an advanced position side to the retracted position side, are provided at opposite positions separated by 180°. In the present embodiment, syringe holding member 6 is a flexible resin molded product, and outer cylinder-side flexible pawls 31*a* are formed integrally with outer cylindrical portion 31, in cut-out portions 31*b* formed in a side surface of outer cylindrical portion 31.

An inner diameter of outer cylinder-side flexible pawls 31*a* on the advanced position side (on a root side) is provided to be substantially identical to an inner diameter of outer cylindrical portion 31, and an inner diameter of outer cylinder-side flexible pawls 31*a* on the retracted position side (on a tip end side) is smaller than the inner diameter of outer cylindrical portion 31.

On an inner peripheral surface of outer cylindrical portion 31, guide protrusions 34 parallel to the central axis are provided at positions rotated by 90° with respect to positions where outer cylinder-side flexible pawls 31*a* are provided. Guide protrusions 34 each have a substantially triangular cross sectional shape. It is noted that the cross sectional shape is not limited to a triangular shape, and may be a semicircular or rectangular shape.

An inner peripheral surface of attachment portion 32 has a diameter substantially identical to that of an outer peripheral surface of mouth portion 12*b* of syringe 2. An internal thread portion 32*a* into which external thread portion 12*c* formed in mouth portion 12*b* is to be screwed is formed in the inner peripheral surface of attachment portion 32.

Grooves 32*b* are formed in internal thread portion 32*a* in the forward-backward direction, at opposite positions with the central axis sandwiched therebetween. Thereby, internal thread portion 32*a* is interrupted and discontinuous.

Grooves 12*d* in external thread portion 12*c* formed in syringe 2 and grooves 32*b* in internal thread portion 32*a* are formed to have an identical width. Grooves 12*d* and 32*b* overlap each other when external thread portion 12*c* is screwed into internal thread portion 32*a*.

(Cannula Holding Member 7)

Cannula holding member 7 has an inner cylindrical portion 41 in the shape of a bottomed cylinder which is opened on the retracted position side and has double-head cannula 5 provided at the center, and separation preventing means 42 preventing separation of syringe 2 from syringe holding member 6 in a pre-use state described later.

Double-head cannula 5 has a syringe-side cannula 5*a* closer to syringe 2, and a vial-side cannula 5*b* closer to vial 3. A channel 5*c* is formed inside syringe-side cannula 5*a* and vial-side cannula 5*b*.

A tip end of syringe-side cannula 5*a* is formed into a conical shape. Channel 5*c* is opened at side surfaces of syringe-side cannula 5*a*. A tip end of vial-side cannula 5*b* is formed obliquely, and channel 5*c* is opened behind a sharp tip end portion.

Syringe-side cannula 5*a* is formed to be finer than vial-side cannula 5*b*. Thereby, puncture resistance obtained when syringe-side cannula 5*a* penetrates syringe lid member 13 is smaller than puncture resistance obtained when vial-side cannula 5*b* penetrates vial lid member 22.

Inner cylindrical portion 41 has an outer diameter substantially identical to the inner diameter of outer cylindrical portion 31 of syringe holding member 6. Inner cylindrical portion 41 has an inner diameter substantially identical to an outer diameter of flange portion 21*a* of vial 3 (including the thickness of ring member 23).

In a side surface portion of inner cylindrical portion 41, two inner cylinder-side flexible pawls 41*a*, each of which is inclined inward on the advanced position side as it extends from the retracted position side to the advanced position side, and is located to be overlapped by outer cylinder-side flexible pawl 31*a* in a state where inner cylindrical portion 41 is accommodated inside outer cylindrical portion 31, are provided at opposite positions separated by 180°. In the present embodiment, cannula holding member 7 is a resin molded product, and inner cylinder-side flexible pawls 41*a* formed in a side surface of inner cylindrical portion 41 are formed integrally with inner cylindrical portion 41.

An inner diameter of inner cylinder-side flexible pawls 41*a* on the retracted position side (on a root side) is provided to be substantially identical to the inner diameter of inner cylindrical portion 41, and an inner diameter of inner cylinder-side flexible pawls 41*a* on the advanced position side (on a tip end side) is smaller than the inner diameter of inner cylindrical portion 41.

A width of inner cylinder-side flexible pawl 41*a* in a circumferential direction is provided to be smaller than a width of outer cylinder-side flexible pawl 31*a* in the circumferential direction. On the advanced position side of cut-out portions 41*b*, inner cylinder abutting surfaces 41*c* which can abut on a tip end portion 31*c* of outer cylinder-side flexible pawl 31*a* are provided on both sides of inner cylinder-side flexible pawl 41*a*. An opening 41*d* opened on a tip end side of inner cylinder-side flexible pawl 41*a* can receive tip end portion 31*c* of outer cylinder-side flexible pawl 31*a*.

On an outer peripheral surface of inner cylindrical portion 41, guide grooves 43 parallel to the central axis are provided at positions rotated by 90° with respect to positions where inner cylinder-side flexible pawls 41*a* are provided. Guide grooves 43 each have a substantially triangular cross sectional shape.

Guide protrusions 34 provided on the inner peripheral surface of outer cylindrical portion 31 are fitted into guide grooves 43, to guide relative movement of syringe holding member 6 and cannula holding member 7 in the advanced/retracted direction, and prohibit relative rotation of syringe holding member 6 and cannula holding member 7. Guide groove 43 may have any shape that allows guide protrusion 34 to be fitted therein. Further, syringe holding member 6 may be provided with guide grooves, and cannula holding member 7 may be provided with guide protrusions.

Separation preventing means 42 has two insertion pieces 42*a* provided at opposite positions with syringe-side cannula 5*a* in inner cylindrical portion 41 sandwiched therebetween. Separation preventing means 42 also has partial thread portions 42*b* on inner sides of tip ends of insertion pieces 42*a*, and stopper members 42*c* provided closer to inner cylindrical portion 41 than partial thread portions 42*b*.

Insertion pieces 42*a* are formed at positions and formed to have a width which allow insertion pieces 42*a* to slide along grooves 32*b* formed in internal thread portion 32*a* in attachment portion 32 of syringe holding member 6. Insertion pieces 42*a* have inner surfaces with a diameter identical to that of the inner peripheral surface of attachment portion 32.

Figure 7A:
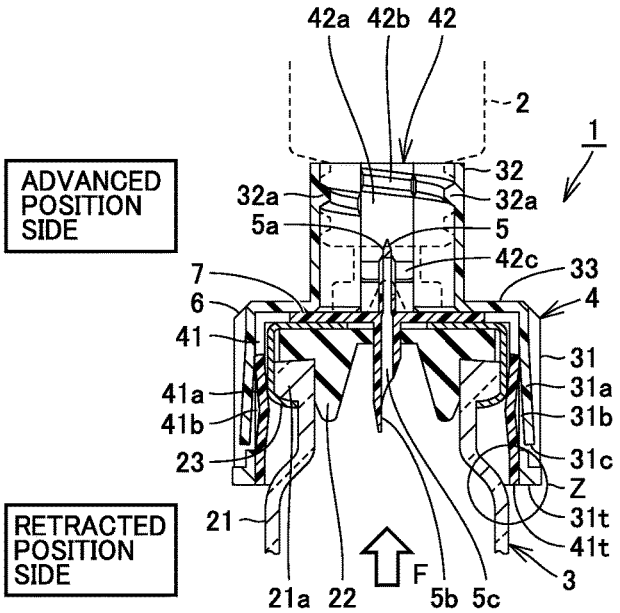
FIG. 7A is a fifth cross sectional view showing a state of connection between the syringe and the vial using the connection device in the present embodiment.

Partial thread portions 42*b* have a shape that continues to internal thread portion 32*a*. When partial thread portions 42*b* are aligned with internal thread portion 32*a* as shown in FIG. 7A described later, internal thread portion 32*a* interrupted by grooves 32*b* forms a continuous internal thread by partial thread portions 42*b*.

Figure 6A:
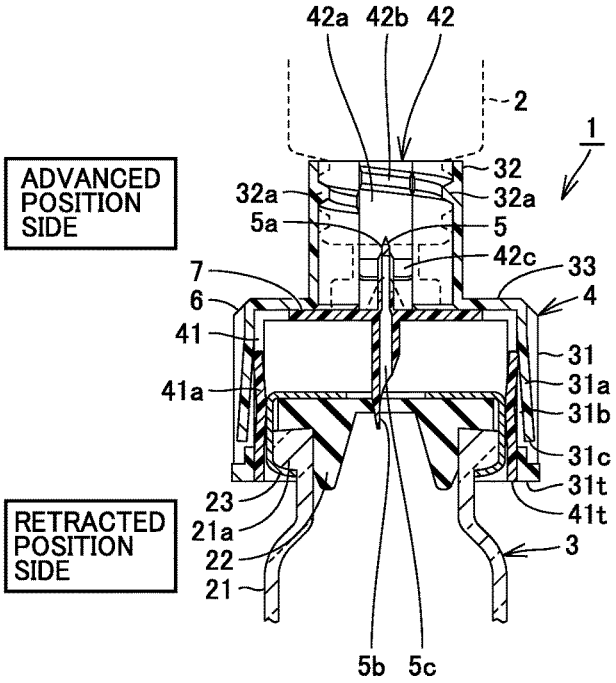
FIG. 6A is a fourth cross sectional view showing a state of connection between the syringe and the vial using the connection device in the present embodiment.
Figure 6B:
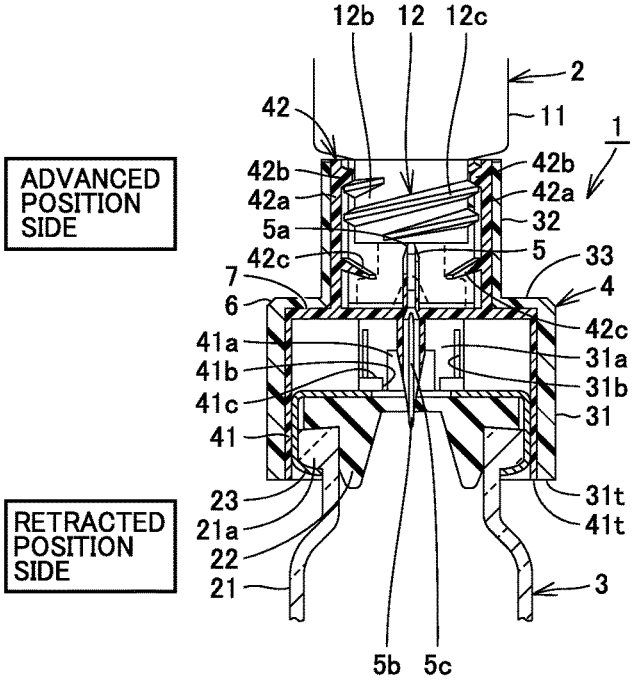
FIG. 6B is a fourth cross sectional view showing a state of connection between the syringe and the vial using the connection device in the present embodiment.
Figure 7B:
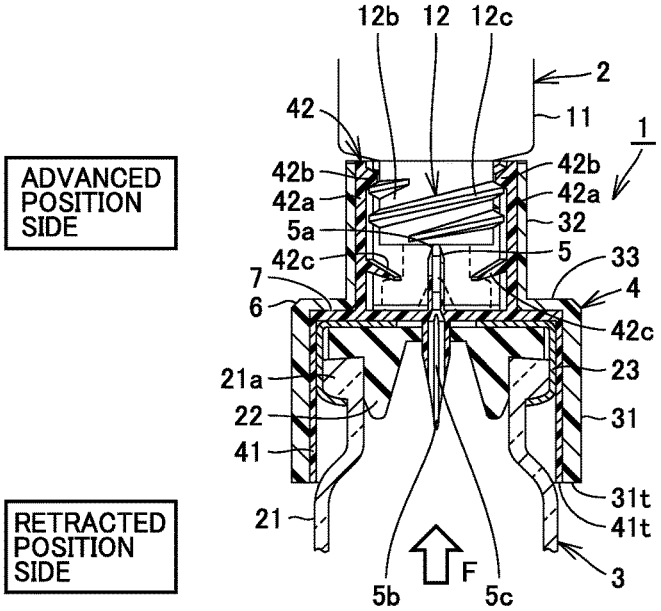
FIG. 7B is a fifth cross sectional view showing a state of connection between the syringe and the vial using the connection device in the present embodiment.

Stopper members 42*c* are elastically deformable, thin plate-like members, and are provided at positions where stopper members 42*c* engage syringe lid member 13 of syringe 2 from a side close to syringe 2 in states shown in FIGS. 6B and 7B.

(Use Method)

Next, a method of using connection device 1 having the above configuration will be described with reference to FIGS. 3A and 3B to FIGS. 7A and 7B. FIGS. 3A and 3B to FIGS. 7A and 7B are first to fifth cross sectional views showing states of connection between the syringe and the vial using the connection device in the present embodiment, in which each Fig. A is a view corresponding to a cross section taken along an arrowed line A-A in FIG. 2, and each Fig. B is a view corresponding to a cross section taken along an arrowed line B-B in FIG. 2.

Figure 3A:
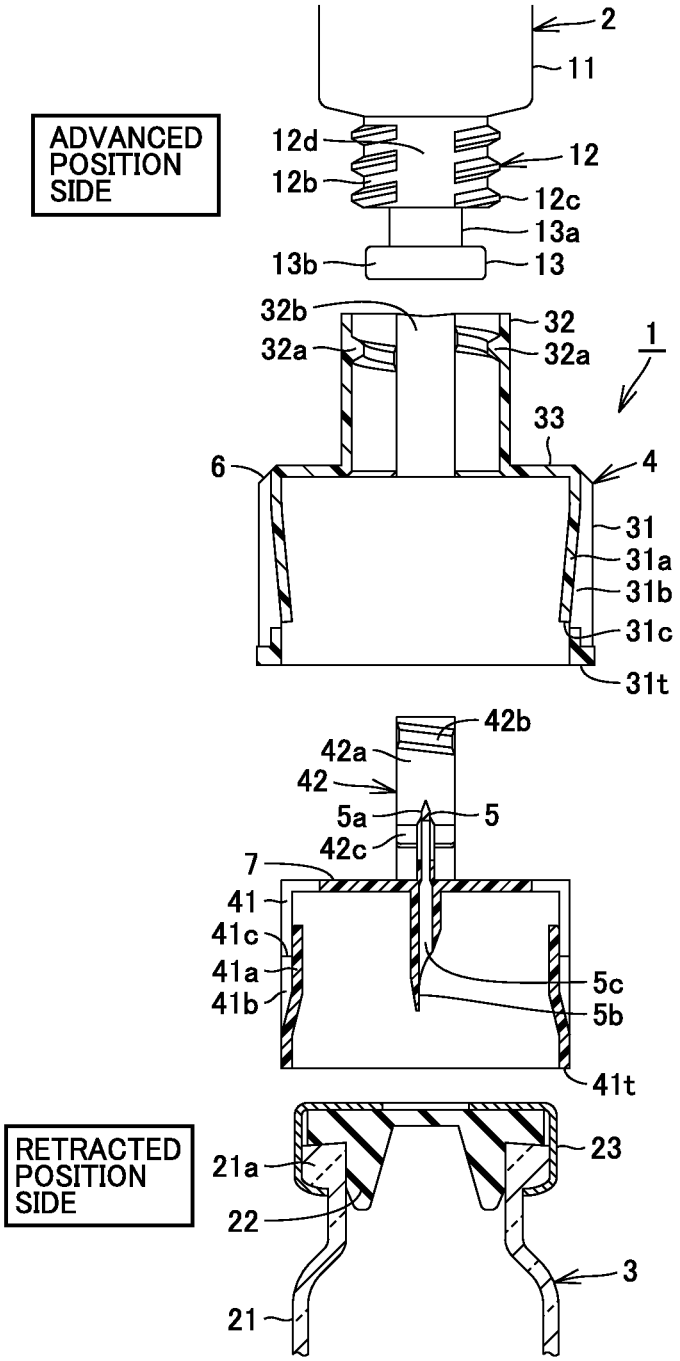
FIG. 3A is a first cross sectional view showing a state of connection between the syringe and the vial using the connection device in the present embodiment.
Figure 3B:
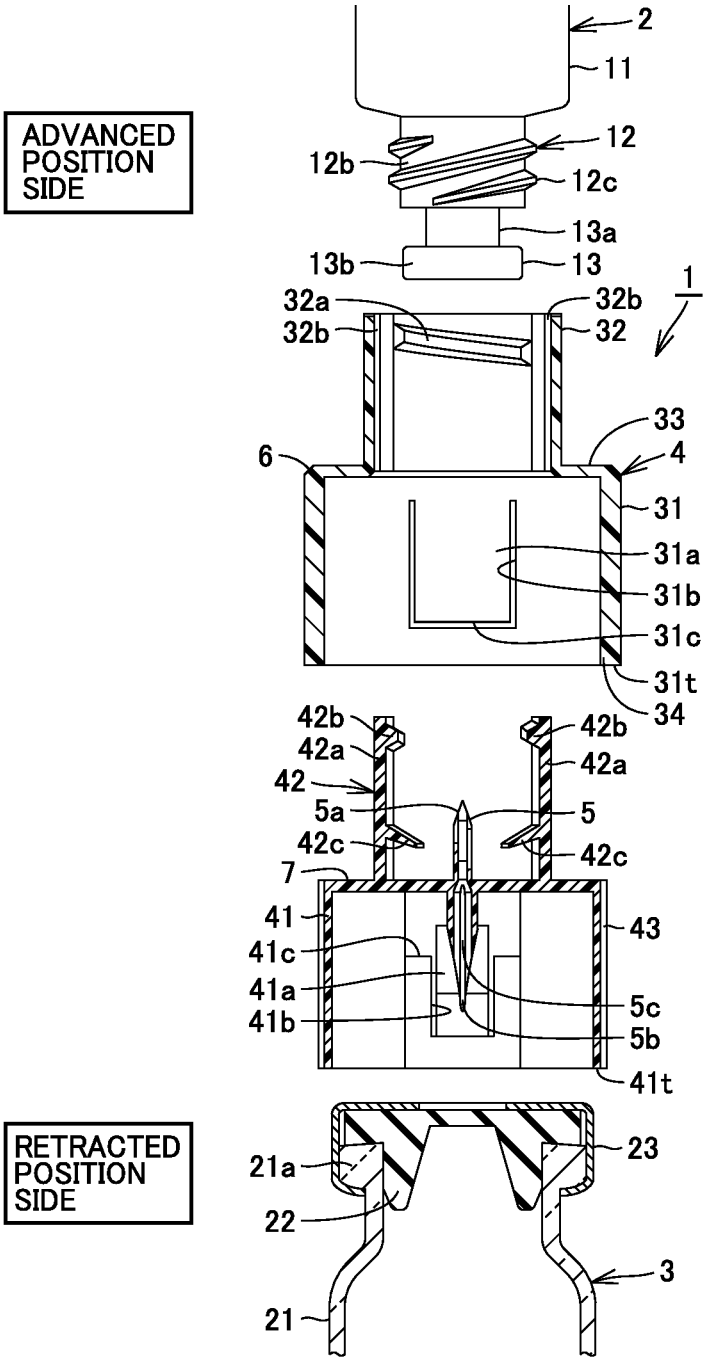
FIG. 3B is a first cross sectional view showing a state of connection between the syringe and the vial using the connection device in the present embodiment.

FIGS. 3A and 3B show an assembly state of connection device 1. Syringe 2 and vial 3 are not connected to connection device 1.

Figure 4A:
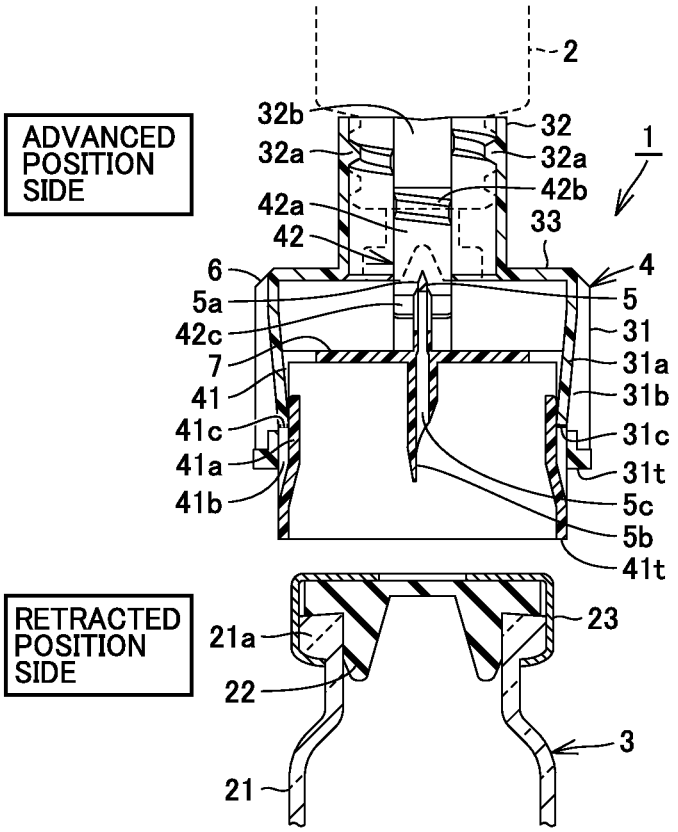
FIG. 4A is a second cross sectional view showing a state of connection between the syringe and the vial using the connection device in the present embodiment.
Figure 4B:
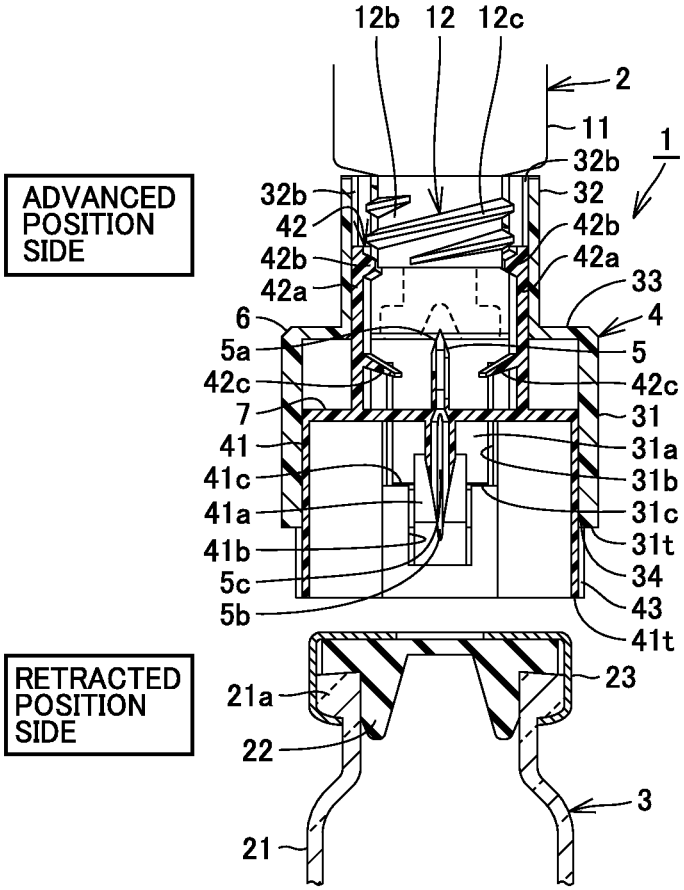
FIG. 4B is a second cross sectional view showing a state of connection between the syringe and the vial using the connection device in the present embodiment.

Next, FIGS. 4A and 4B show an attachment state in which syringe 2 is connected to connection device 1. An operation of screwing external thread portion 12*c* formed in connection portion 12 of syringe 2 into internal thread portion 32*a* in attachment portion 32 of syringe holding member 6 is performed. As a result, when external thread portion 12*c* is fully screwed into internal thread portion 32*a*, grooves 12*d* formed in external thread portion 12*c* and grooves 32*b* formed in internal thread portion 32*a* overlap each other.

Next, an operation of inserting inner cylindrical portion 41 of cannula holding member 7 into outer cylindrical portion 31 of syringe holding member 6 and stopping cannula holding member 7 at a retracted position is performed. Specifically, inner cylindrical portion 41 of cannula holding member 7 is inserted into outer cylindrical portion 31 of syringe holding member 6 to obtain a state where tip end portions 31*c* of outer cylinder-side flexible pawls 31*a* abut on inner cylinder abutting surfaces 41*c* and movement of inner cylindrical portion 41 to an advanced position is prevented. Thereby, cannula holding member 7 is stopped at the retracted position.

Figure 5A:
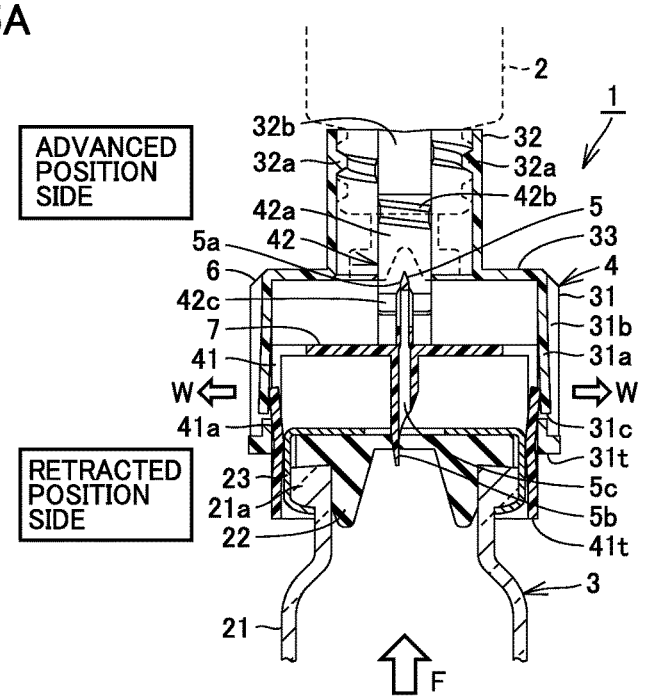
FIG. 5A is a third cross sectional view showing a state of connection between the syringe and the vial using the connection device in the present embodiment.
Figure 5B:
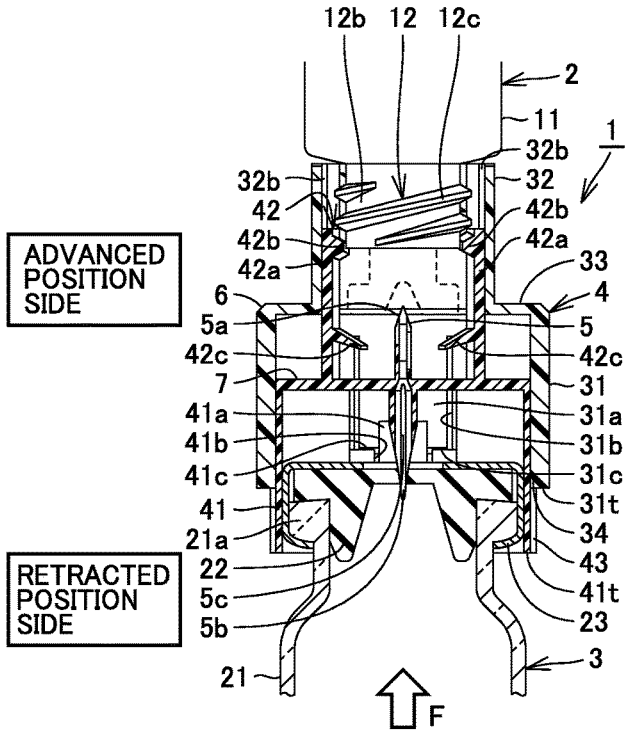
FIG. 5B is a third cross sectional view showing a state of connection between the syringe and the vial using the connection device in the present embodiment.

Next, FIGS. 5A and 5B show a pre-use state in which connection device 1 having syringe 2 connected thereto is set on vial 3. Vial 3 is pushed forward into inner cylindrical portion 41 (in a direction indicated by an arrow F in the drawing), in the state where tip end portions 31*c* of outer cylinder-side flexible pawls 31*a* abut on inner cylinder abutting surfaces 41*c* and movement of inner cylindrical portion 41 to the advanced position is prevented. Thereby, a state where ring member 23 is held by inner cylindrical portion 41 is started, and a portion of vial-side cannula 5*b* punctures vial lid member 22.

When vial 3 is further pushed forward into inner cylindrical portion 41, inner cylinder-side flexible pawls 41*a* are pushed outward (in directions indicated by arrows W in the drawing) by ring member 23. At the same time, outer cylinder-side flexible pawls 31*a* are also pushed outward by inner cylinder-side flexible pawls 41*a* pushed outward. This results in a state where abutting of tip end portions 31*c* of outer cylinder-side flexible pawls 31*a* on inner cylinder abutting surfaces 41*c* is released, and movement of inner cylindrical portion 41 to the advanced position is permitted.

In the state shown in FIGS. 5A and 5B, partial thread portions 42*b* of separation preventing means 42 are stopped at positions misaligned with respect to internal thread portion 32*a*. As a result, if an attempt is made to rotate syringe 2 and syringe holding member 6 in this pre-use state, external thread portion 12*c* of syringe 2 interferes with partial thread portions 42*b*. Thus, rotation of syringe 2 and syringe holding member 6 is prevented, and syringe 2 cannot be separated from syringe holding member 6.

Next, FIGS. 6A and 6B show a state in which cannula holding member 7 holding vial 3 is advanced from the retracted position to the advanced position with respect to syringe holding member 6, in a state where a portion of vial-side cannula 5*b* punctures (i.e., does not penetrate) vial lid member 22, and vial 3 is caused to abut on a bottom surface of inner cylindrical portion 41.

When syringe 2 and vial 3 are brought close to each other, cannula holding member 7 is pressed by vial 3 and attempts to move to the advanced position. Here, since syringe-side cannula 5*a* is finer and has a smaller puncture resistance than vial-side cannula 5*b*, cannula holding member 7 moves to the advanced position with respect to syringe holding member 6, and syringe-side cannula 5*a* first penetrates syringe lid member 13 of syringe 2.

When cannula holding member 7 is located at the advanced position, stopper members 42*c* provided to insertion pieces 42*a* pass over large diameter portion 13*b* of syringe lid member 13 in syringe 2 while being deformed, and engage large diameter portion 13*b* from the side close to syringe 2.

It is noted that actual operation can proceed from the pre-use state in FIG. 5 to a use state in FIGS. 7A and 7B without stopping, and does not have to be stopped in the states in FIGS. 4A, 4B, 5A, 5B, 6A, and 6B.

Next, FIGS. 7A and 7B show the use state in which syringe 2 and vial 3 are further brought close to each other from a syringe-side penetrated state and communication is established between internal spaces of syringe 2 and vial 3. Vial 3 is further advanced from the syringe-side penetrated state in FIGS. 6A and 6B. Ring member 23 of vial 3 abuts on a bottom portion of inner cylindrical portion 41, and thus vial-side cannula 5*b* of double-head cannula 5 penetrates vial lid member 22 of vial 3, and thereby communication is established between the internal space of syringe 2 and the internal space of vial 3.

It is noted that actual operation can proceed from the pre-use state in FIG. 5 to the use state in FIGS. 7A and 7B without stopping, and does not have to be stopped in the states in FIGS. 4A, 4B, 5A, 5B, 6A, and 6B.

In the use state in FIGS. 7A and 7B, a user performs an operation of operating syringe 2 to inject the solution into vial 3 to dissolve the medicament inside vial 3 with the solution, and then drawing the dissolved medicament again into syringe 2.

After the user draws the medicament mixed as described above into syringe 2, the user can separate syringe 2 from connection device 1, attach a cannula for puncture to syringe 2, and administer the medicament to a patient using syringe 2.

When syringe 2 is separated from connection device 1, cannula holding member 7 is located at the advanced position, and partial thread portions 42*b* of separation preventing means 42 are continuous with internal thread portion 32*a* of syringe holding member 6.

As a result, partial thread portions 42*b* do not interfere with external thread portion 12*c* of syringe 2, and thereby rotation of syringe 2 and syringe holding member 6 can be permitted, and syringe 2 can be separated.

On the other hand, when cannula holding member 7 is located at the advanced position, stopper members 42*c* pass over large diameter portion 13*b* of syringe lid member 13 in syringe 2 while being deformed, and engage large diameter portion 13*b* from the side close to syringe 2. As a result, when syringe 2 is separated from syringe holding member 6, syringe lid member 13 can be removed from syringe 2, with engagement thereof with syringe holding member 6 being maintained by stopper members 42*c*.

Further, the length of outer cylindrical portion 31 in a central axis direction is set with respect to the length of inner cylindrical portion 41 in the central axis direction such that, when cannula holding member 7 is in the use state, a position of an end portion 31*t* of outer cylindrical portion 31 on the retracted position side does not protrude to the retracted position side, with respect to a position of an end portion 41*t* of inner cylindrical portion 41 on the retracted position side, as shown in FIGS. 7A and 7B. Specifically, the position of end portion 31*t* of outer cylindrical portion 31 and the position of end portion 41*t* of inner cylindrical portion 41 are substantially identical.

As described above, according to connection device 1 of the present embodiment, since partial thread portions 42*b* of separation preventing means 42 engage external thread portion 12*c* of syringe 2 in the pre-use state, syringe 2 cannot be removed from connection device 1.

Thereafter, when communication is established between the internal spaces of syringe 2 and vial 3 as the use state, partial thread portions 42*b* are aligned with internal thread portion 32*a* of syringe holding member 6 to permit rotation of external thread portion 12*c*, and thus syringe 2 can be separated from connection device 1.

That is, connection device 1 is designed such that syringe 2 cannot be separated in a state where no communication is established between syringe 2 and vial 3. Therefore, connection device 1 can prevent an error by the user, and prevent the user from forgetting to perform an operation of establishing communication between syringe 2 and vial 3.

Further, the length of outer cylindrical portion 31 in the central axis direction is set with respect to the length of inner cylindrical portion 41 in the central axis direction such that, when cannula holding member 7 is in the use state, the position of end portion 31*t* of outer cylindrical portion 31 on the retracted position side does not protrude to the retracted position side, with respect to the position of end portion 41*t* of inner cylindrical portion 41 on the retracted position side.

As a result, end portion 31*t* of outer cylindrical portion 31 does not abut on bottle portion 21 of vial 3, not only in a case where the outer diameter of bottle portion 21 of vial 3 is substantially identical to that of ring member 23 as shown in each drawing (for example, in the case of a 10-mL vial) but also in a case where the outer diameter of bottle portion 21 of vial 3 is larger than that of ring member 23 (for example, in the case of a 20-mL vial).

Thereby, vial 3 can be held by holding means 4 irrespective of the size of bottle portion 21 of vial 3.

Although the embodiment of the present invention has been described above, it should be understood that the embodiment disclosed herein is illustrative and non-restrictive in every respect. The scope of the present invention is defined by the scope of the claims, and is intended to include any modifications within the scope and meaning equivalent to the scope of the claims.

REFERENCE SIGNS LIST

1: connection device; 2: syringe; 3: vial; 4: holding means; 5: double-head cannula; 5*a*: syringe-side cannula; 5*b*: vial-side cannula; 5*c*: channel; 6: syringe holding member; 7: cannula holding member; 11: barrel; 12: connection portion; 12*a*: tapered portion; 12*b*: mouth portion; 12*c*: external thread portion; 12*d*, 32*b*: groove; 13: syringe lid member; 13*a*: small diameter portion; 13*b*: large diameter portion; 21: bottle portion; 21*a*: flange portion; 22: vial lid member; 23: ring member; 31: outer cylindrical portion; 31*a*: outer cylinder-side flexible pawl; 41*a*: inner cylinder-side flexible pawl; 31*b*, 41*b*: cut-out portion; 31*c*: tip end portion; 31*t*, 41*t*: end portion; 32: attachment portion; 32*a*: internal thread portion; 33: step difference portion; 34: guide protrusion; 41: inner cylindrical portion; 41*c*: abutting surface; 41*d*: opening; 42: separation preventing means; 42*a*: insertion piece; 42*b*: partial thread portion; 42*c*: stopper member; 43: guide groove.

The invention claimed is:

1. A connection device, comprising:

holding means spacing a syringe and a vial from each other or bringing said syringe and said vial close to each other; and a double-head cannula which is located between a syringe lid member attached to said syringe and a vial lid member attached to a ring member provided to said vial, and which can penetrate said syringe lid member and said vial lid member, the connection device switching from a pre-use state in which said holding means spaces said syringe and said vial from each other and said double-head cannula does not penetrate said syringe lid member and said vial lid member, to a use state in which said holding means brings said syringe and said vial close to each other and said double-head cannula penetrates said syringe lid member and said vial lid member to establish communication between internal spaces of said syringe and said vial, wherein said holding means includes a syringe holding member to be attached to said syringe, a cannula holding member which has said double-head cannula, is located at a retracted position retracted with respect to said syringe holding member in said pre-use state, and is advanced to an advanced position abutting on said syringe holding member in said use state, and separation preventing means which engages said syringe to prevent separation of said syringe from said syringe holding member in the state where said cannula holding member is located at said retracted position, and releases an engagement state with said syringe to permit the separation of said syringe from said syringe holding member when said cannula holding member is located at said advanced position, said syringe holding member has an outer cylindrical portion which is opened on a retracted position side and accommodates said cannula holding member to be movable between said retracted position and said advanced position, said cannula holding member has an inner cylindrical portion which is opened on said retracted position side, is accommodated inside said outer cylindrical portion, and holds said ring member of said vial, and when said cannula holding member is in said use state, a position of an end portion of said outer cylindrical portion on said retracted position side does not protrude to the retracted position side, with respect to a position of an end portion of said inner cylindrical portion on said retracted position side.

2. The connection device according to claim 1, wherein an engagement mechanism is provided between said outer cylindrical portion and said inner cylindrical portion, in a state where said inner cylindrical portion does not hold said ring member, movement of said inner cylindrical portion to said advanced position is prevented by said engagement mechanism, and in a state where said inner cylindrical portion holds said ring member, the movement of said inner cylindrical portion to said advanced position is permitted by releasing said engagement mechanism.

3. The connection device according to claim 2, wherein said engagement mechanism includes an outer cylinder-side flexible pawl which is provided in a side surface portion of said outer cylindrical portion, and is inclined inward on said retracted position side as said outer cylinder-side flexible pawl extends from an advanced position side to said retracted position side, an inner cylinder-side flexible pawl which is provided in a side surface portion of said inner cylindrical portion, is inclined inward on said advanced position side as said inner cylinder-side flexible pawl extends from said retracted position side to said advanced position side, and is located to be overlapped by said outer cylinder-side flexible pawl in a state where said inner cylindrical portion is accommodated inside said outer cylindrical portion, and an inner cylinder abutting surface which is provided in the side surface portion of said inner cylindrical portion, is located outside said inner cylinder-side flexible pawl in a circumferential direction of said inner cylindrical portion, and can abut on a tip end portion of said outer cylinder-side flexible pawl, in the state where said inner cylindrical portion does not hold said ring member, the movement of said inner cylindrical portion to said advanced position is prevented by said tip end portion of said outer cylinder-side flexible pawl abutting on said inner cylinder abutting surface, and in the state where said inner cylindrical portion holds said ring member, the movement of said inner cylindrical portion to said advanced position is permitted by releasing abutting of said tip end portion of said outer cylinder-side flexible pawl on said inner cylinder abutting surface by pushing said inner cylinder-side flexible pawl outward by said ring member and thereby also pushing said outer cylinder-side flexible pawl outward.

* * * * *